US005581448A

United States Patent [19]

Harwood

[11] Patent Number: 5,581,448

[45] Date of Patent: Dec. 3, 1996

[54] DISPLAY LIGHTING SYSTEM FOR WALLS

[76] Inventor: Ronald P. Harwood, 3110 Applewood, Farmington Hills, Mich. 48331

[21] Appl. No.: 512,665

[22] Filed: Aug. 8, 1995

[51] Int. Cl.[6] ..... F21S 1/02

[52] U.S. Cl. ..... 362/147; 362/368; 362/365; 362/364; 362/249

[58] Field of Search ..... 362/147, 148, 362/263, 265, 237, 238, 240, 241, 247, 249, 364, 365, 226, 368

[56] References Cited

U.S. PATENT DOCUMENTS

| | | | |
|---|---|---|---|
| 3,302,019 | 1/1967 | Menzin . | |
| 3,660,820 | 5/1972 | Liberman . | |
| 3,883,732 | 5/1975 | Peterson et al. . | |
| 3,885,147 | 5/1975 | Chacon . | |
| 4,302,798 | 11/1981 | Sit | 362/147 |
| 4,403,278 | 9/1983 | Flood . | |
| 4,453,202 | 6/1984 | Morris et al. | 362/147 |
| 4,745,533 | 5/1988 | Smerz . | |
| 4,748,543 | 5/1988 | Swarens . | |
| 4,829,410 | 5/1989 | Patel | 362/147 |
| 5,174,642 | 12/1992 | Brohard et al. . | |

*Primary Examiner*—Denise L. Gromada
*Assistant Examiner*—Thomas N. Sember
*Attorney, Agent, or Firm*—Brooks & Kushman P.C.

[57] ABSTRACT

A display lighting system for walls (10) is disclosed which have a housing insertable into the ceiling of a room near the wall desired to be washed by the light from the lighting system. The housing (12) includes an opening from the housing to the room designed by flanges (26). A lamp tray (14) is positioned within the housing by raising it at an angle into the interior of the housing and then rotating it so each of the angularly related legs (56, 58) can be moved through the opening in the housing and then rotated so that each leg rests upon opposing interior portions of the flanges. The leg (56) furthest from the wall to be washed provides an elongated lamp support disposed at an acute angle to the wall so to direct lamps (28) positioned through holes (66) of the light tray towards the wall to be lit. Also disclosed is an electrical compartment (30) centrally located on the housing provided two-handed access from below when the lamp tray and accent plate (34) are removed. Also disclosed is a method for installing the housing in the ceiling and the lamp tray in the housing.

14 Claims, 4 Drawing Sheets

DISPLAY LIGHTING SYSTEM FOR WALLS

TECHNICAL FIELD

The present invention relates generally to lighting support assemblies. More particularly, the invention involves a wall wash lighting system suitable for easy assembly and access for use with non-ambient and/or ambient lighting fixtures in commercial and retail applications.

BACKGROUND OF THE INVENTION

In designing proper lighting for commercial and retail applications, it is necessary to consider the total space to be lighted and the specific activities that may be performed within the perspective lighted area. Normally track lighting is used with surface or recessed spotlight assemblies. In particular concern to the present invention, specialized lighting units for directing light so to spotlight and accent portions of walls and merchandise have been developed. These units, called wall wash units, serve aesthetic purposes and may also serve to highlight merchandise positioned along the walls.

Wall washing may be accomplished by flood or wide beam patterns of non-ambient or "spot" lighting. Such lighting is generally accomplished by use of incandescent filament lamps. Non-ambient lamps vary in luminosity and in heat-generation characteristics. Adding filters to the lamps will often aid in creating the desired effect.

Sometimes it is advantageous to use a combination of ambient and non-ambient or spotlighting in wall wash lighting equipment to create an attractive wall wash.

Ambient lighting can be effected in these units by incandescent or halogen lamps, fluorescent lamps, or high-intensity-discharge lamps. For commercial and retail occupations, high-intensity-discharge ("HID") lamps are preferable as they can provide a greater luminosity per watt of energy than either incandescent or fluorescent lamps. HID lamps generally require a ballast system.

As those skilled in the art will recognize, the ballast system provides circuitry and electrical components necessary for reducing the required voltage supply and for start up, reactances, and power-factor-correcting capacities. All of these electrical components are placed inside a case filled with a potting compound in the entire ballast element. The ballast element is of comparatively large size when measured against the size of the HID lamp. The ballast is usually fixed in a position relatively close to the HID lamp and obviously must be in electrical communication with the HID lamp.

Since it is necessary to replace lamps in wall units periodically, and it is desirable to periodically rearrange the lamps for aesthetic and commercial reasons, any wall wash unit should be readily accessible. Since these units are often used in retail and commercial settings where professional electricians are not available, it is desirable that the access to the wall wash unit can be undertaken by one of little working knowledge of electrical devices. Even if professional electricians are used, ease of access is important to limit the time necessary to employ the electrician. Similarly, since wall wash units are located in the ceilings of retail establishments, anyone undertaking the maintenance or rearrangement of the lights should have easy access to the units and be impeded by as few tools as possible.

Others in the past have sought to provide easy access to lighting units. For example, U.S. Pat. No. 3,883,732 to Peterson, et al. shows an illuminaire adapted for mounting in suspended ceilings which has modular construction to facilitate installation and assembly. The unit includes a rectangular open bottom housing adapted to rest on the ceiling support bars. It also includes a removable ballast supporting panel which forms a wall of the housing. U.S. Pat. No. 4,748,543 to Swarens shows a wall wash unit which does not need tools to provide access to its interior. Both require springs to hold the lamp supports in place.

DISCLOSURE OF THE INVENTION

It is the general objective of the present invention to provide a lighting system capable of easy installation and simple maintenance where the lighting patterns can be readily changed.

A more specific objective of the present invention is the provision of a system which has all elements easily accessible without the use of tools or undue force. Yet another more specific objective is to provide a lighting system where different lamps may be readily positioned in the lighting system.

Another objective of the present invention is to provide a method of easy assembly of a wall wash unit.

In carrying out the above objects, the present invention provides flange wall wash lighting system having a housing securable through the ceiling of a room and a location near the wall to be washed. The housing has a first opening communicating between the room and the interior of the housing, and a second opening between the interior and an electrical control enclosure. The electrical control enclosure is closed by a cover over the second opening except for electrical connectors allowing electrical communications between the enclosure and the interior. Supports are provided along the perimeter of the first opening upon which rest angularly related legs of an elongated tray during operation. The first leg of the tray forms an acute angle to the wall so that lamps positioned in a series of openings on the leg are directed to the wall by the angle of the leg to the wall. The tray is rotatable by hand within the interior of the housing so that its legs may clear the supports and the tray be removed from the interior of the housing. Preferably, the opening to the electrical control enclosure lies above and substantially at the center of the opening leading to the room and is of a size to allow two hand access into the enclosure.

Also disclosed is a method for installing a wall lighting system by providing an opening in the ceiling through which is positioned a housing of the system which has an interior opening to the room below. Energy is provided to the housing for energizing lamps which are positioned at holes on one leg of a pair of angularly related legs of a lamp tray. The lamp tray is moved into the interior of the housing through an opening by maintaining the lamp tray at an angle where the effective width is less than the distance between flanges on opposite sides of the opening in the housing. The lamp tray is then rotated while in the interior of the housing so the effective width is greater than the distance between the flanges and lowered so that the legs rest on the flanges. The leg with lamps is thereby maintained at an angle to the wall so that the lamp will light portions of the wall.

Other objectives, advantages, and embodiments of this invention will be readily understood by those skilled in the art upon review of the accompanying drawings, taken together with the following detailed description which illustrates and describes what are presently considered the preferred embodiments of the best mode contemplated for practicing the invention which is defined in the claims attached hereto.

BEST MODE FOR CARRYING OUT THE INVENTION

Figure 1:
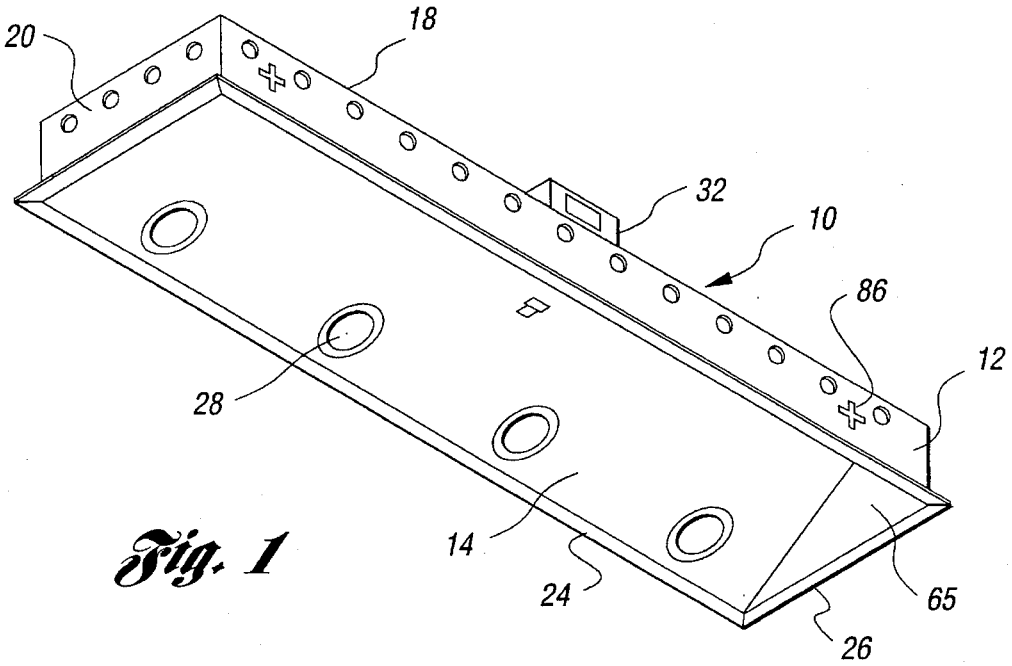
FIG. 1 is a bottom perspective view of a flange wall wash lighting system of the present invention.
Figure 2:
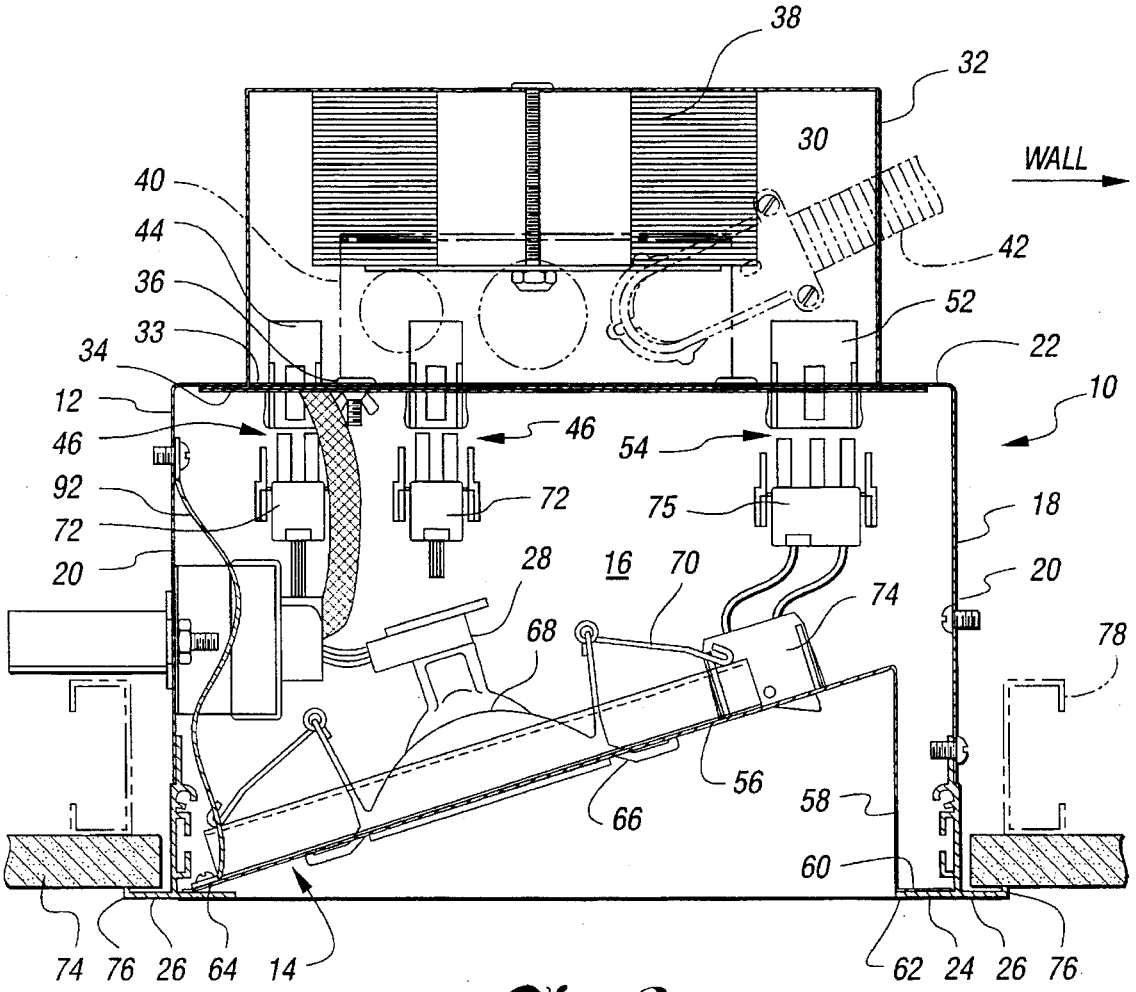
FIG. 2 is a side view cross section of the embodiment of FIG. 1 showing details of the plugs.
Figure 3:
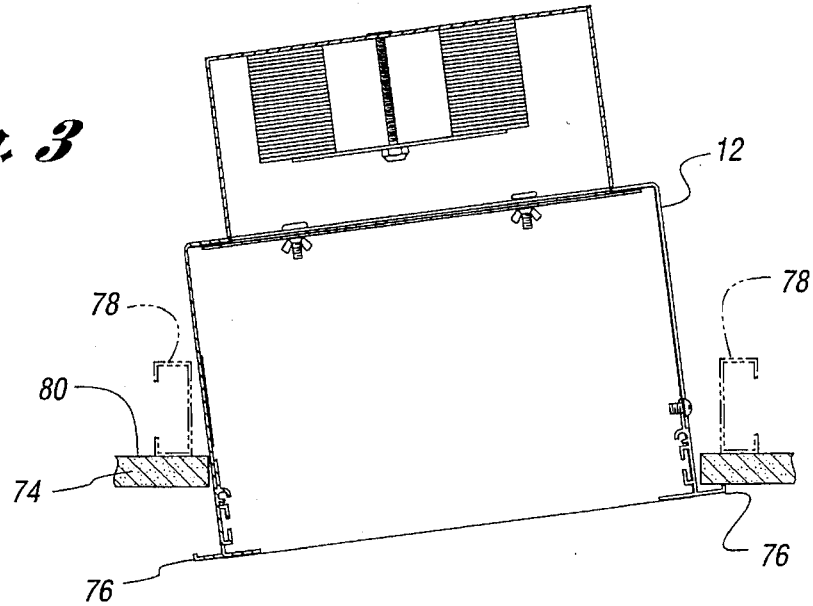
FIGS. 3–5 are side view cross sections showing steps of installation of the housing of the invention in a ceiling.
Figure 4:
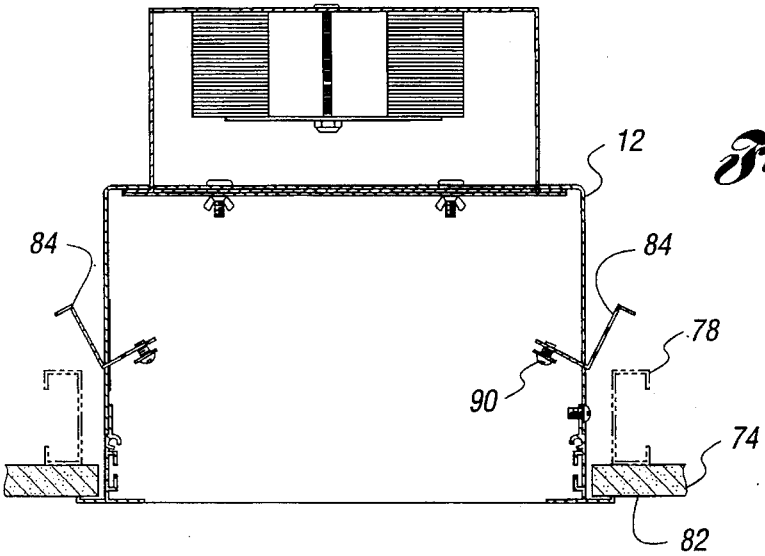
Figure 5:
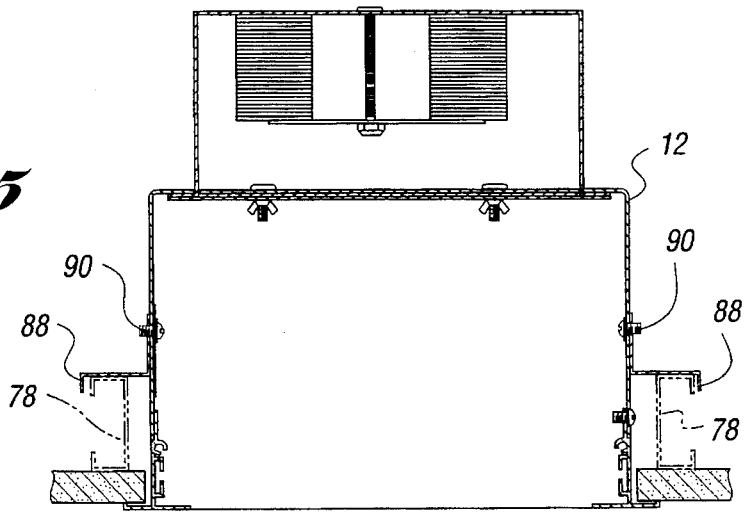
Figure 6:
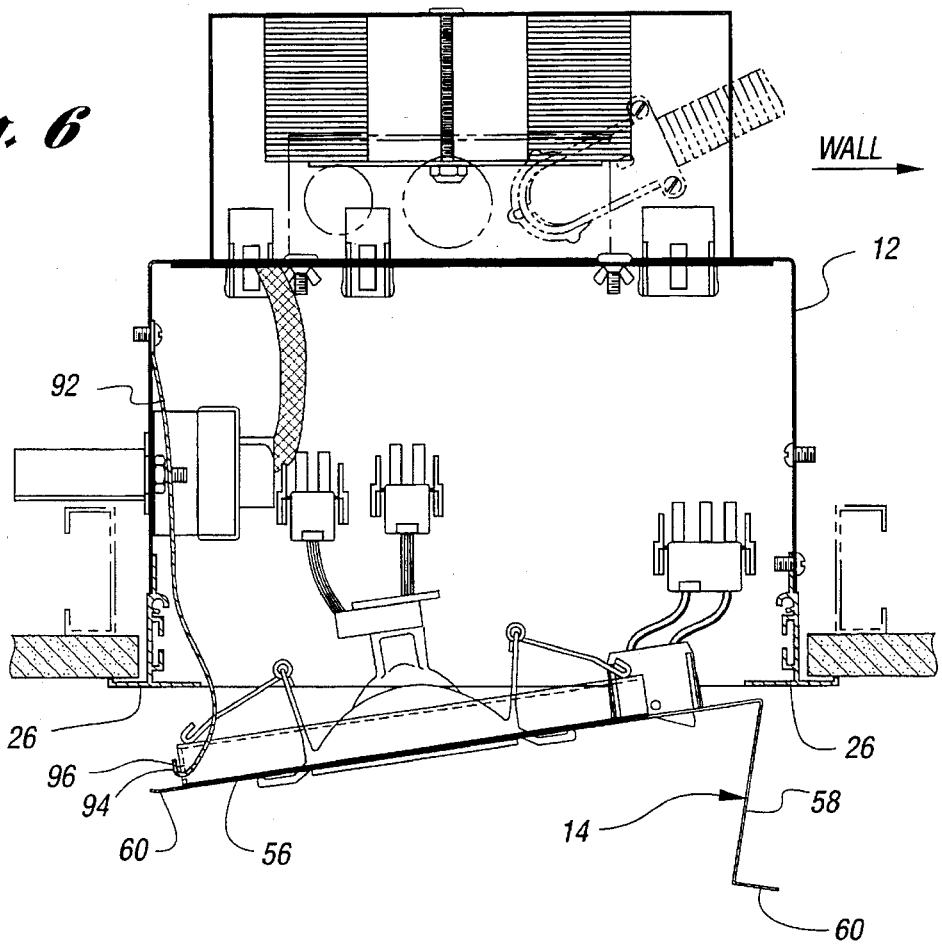
FIG. 6 placement of the lamp tray of the embodiment of FIG. 1 prior to final positioning within the housing.

Referring now to FIG. 1 there is shown generally a flange wall wash lighting system designed in accordance with the teachings of the present invention designated generally by reference 10. Lighting system 10 consists of a housing 12 and lamp tray 14. Housing 12 defines two general areas of enclosure. The first 16 is an enclosure for the lamps defined by an elongated rectangular box 18, having four sides 20, an upper surface 22 and a lower surface 24 and lamp tray 14, which sit on the lower surface of the housing. Lamp box 18 has an opening to the area to be lighted in its lower surface 24. The lower surface consists of an inverted T-shaped flange 26 at the bottom of the box sides.

The length of the lamp box 18 will be dependent upon the number of lamps 28 desired in the lighting system. Shown in FIG. 1 is the lighting system featuring four lamps. However, the number of lamps may vary. Multiple lamps are to be used to gain the advantages of the easy interchangeability of the current invention. Preferably, the number of lamps should be not less than three and not more than six, since less than three lamps does not generally allow for creating an effective wall wash effect and, when more than six lamps are used, accessing the interior of the lighting enclosure becomes difficult due to the weight of the tray.

The second enclosure defined by the housing is electrical compartment 30 defined by an opening 33 in the upper surface 22 of box 18 and sides and top of electrical box 32 placed on the top of lamp box 18. Access to the interior of electrical compartment 30 is normally by means of the access opening 33 in the upper surface 22 of lamp box 18 of such a size suitable for two-handed access into the interior. The access opening 33 is normally closed and sealed by access plate 34 which is in turn held in place by screws 36, preferably four thumb screws so they may be tightened or removed without the need for tools.

Electrical compartment 30 provides an essentially dust-free environment for placement of electrical components for controlling the lamps. These components include transformer 38 and junction box 40. The electrical components are connected to an outside source of electrical supply through conduit 42.

Transformer 38 is electrically connected through junction box 40 to the female portions 44 of quick-connect/disconnect plugs 46 for use in connection to lamps. Four plugs, one for each lamp, are provided although only two are shown.

Electrical power to the junction box is controlled by wiring that leads to and from the female portion 52 of a quick-connect/disconnect plug 54. The various female portions of the quick-connect/disconnect plugs are joined to and extend through access plate 34.

The lamp tray 14 is an angularly-shaped piece of metal designed to close the opening of the lamp box 18 to the area to be lighted below. When positioned within the housing, it has a leg 56 in the form of an elongated lamp support that faces toward the wall to be washed at an acute angle. A leg 58 of the lamp tray extends from the lamp support downwardly and substantially parallel to the wall to be washed at an acute angle to a lamp support. The lower portion of the legs are designed to rest on opposing interior portions of flange 26 of lamp box 18. Each leg has a lower flange portion or foot 60 aligned with the flange 26 so to provide that the tray firmly sits on the flange 26. These opposing flange portions are preferably the interior portion of the flange 62 attached to the side of the lamp box closest to the wall to be lit and the interior portion of the flange 64 attached to the side of the lamp box furthest from the wall to be lit. The edges of the legs are joined by end plates 65.

The first leg of lamp support 56 has holes 66 corresponding to number of lamps in the unit. Lamp housings 68 are placed through the hole and held in place by springs 70. Preferably, the lamp housings are of the type that allow access to the lamp from below for bulb replacement without accessing the interior of the lamp enclosure 16. The angular relationship of the lamp support 50 to the wall point the lamps at the wall in a wall-washing manner. The lamps and their housings are preferably interchangeable between holes to allow different wall wash effects. Thus, the four lamps may be a pair of 50 watt MR-16 spot lamps with a pair of 50 watt MR-16 spot lamps with spread lens. Although this embodiment features low voltage lamps, lamps powered by line voltage can also be used. To aid in precise placement of the lamps for giving the desired effect, the lamp housings may provide for limited rotation of the direction of the lamps in a manner known to those skilled in the art. Lamp housings allowing replacement from below and limited rotation are commercially available, such as the from sources such as Reggiana S.P.A. of Italy.

Each lamp 20 is joined to a respective male portion of a quick-connect/disconnect plug 72 corresponding to a plug 46. Also placed on the lamp tray is switch 74 joined to a male portion 75 of plug 54 for turning the lamps of the lighting system on or off. This is normally to be used with a remote on/off switch for controlling banks of lights during normal operation.

The primary advantage of the current invention is its ease of installation and maintenance. To install the lighting system, a suitable opening is made in the ceiling 74 of a size slightly larger than the lamp enclosure 18 as defined by its sides 20 and of a size less than the outer area of the housing defined the outer ends 76 of flanges 26. Channels 78 are placed on the upper surface 80 of ceiling 74 along the ceiling opening preferably parallel to the wall to be washed. Housing 12 is then placed through the opening until the ends 76 of its flanges 26 about the lower surface 82 of the ceiling. At that point, locking members in the form of mounting lugs 84 are inserted through elongated openings 86 in each side wall of lamp box 18. Each mounting lug 84 has a portion 88 that can be rotated over and corresponds to the upper surface of channels 78. The mounting lug is then joined to the housing by screws 90 thereby locking the housing in place.

The lamp tray is then moved under the housing. A safety chain 92 located at the end of the lamp support surface furthest from the wall is then connected to the interior of the housing by hook 94 and eyelet 96, thus preventing the lamp tray from dropping to the floor if it is dropped. The various quick-connect plug connections for the lamps are then made. The safety chain also allows easier handling of the lamp tray during the connection of the plugs. The lamp tray is then rotated along an longitudinal axis so that the horizontal distance between the edges of the lamp support tray furthest from the wall to the end of the flange closest to the wall is less than the width of the opening between the flanges 26 of the housing. The lamp tray is then moved upward into the interior of the lamp box 18 and then rotated back until its width is greater than the distance between the flanges 26 so that leg 56 of the lamp tray rests upon the upper surface of the interior flange portion 64 and leg 58 rests upon the upper surface of interior flange portion 62.

At this point, the unit may be turned on and safely used. Adjustments of the lamps to their precise location by rotation within housings 68 should be performed at this time.

Once positioned, maintenance of the unit is easily performed from below. When a new aesthetic lighting pattern is desired, by merely climbing a ladder, the lamps can be rotated from below to their new desired spot. Similarly, a burned-out bulb can be easily replaced from below without opening up the unit.

Figure 7:
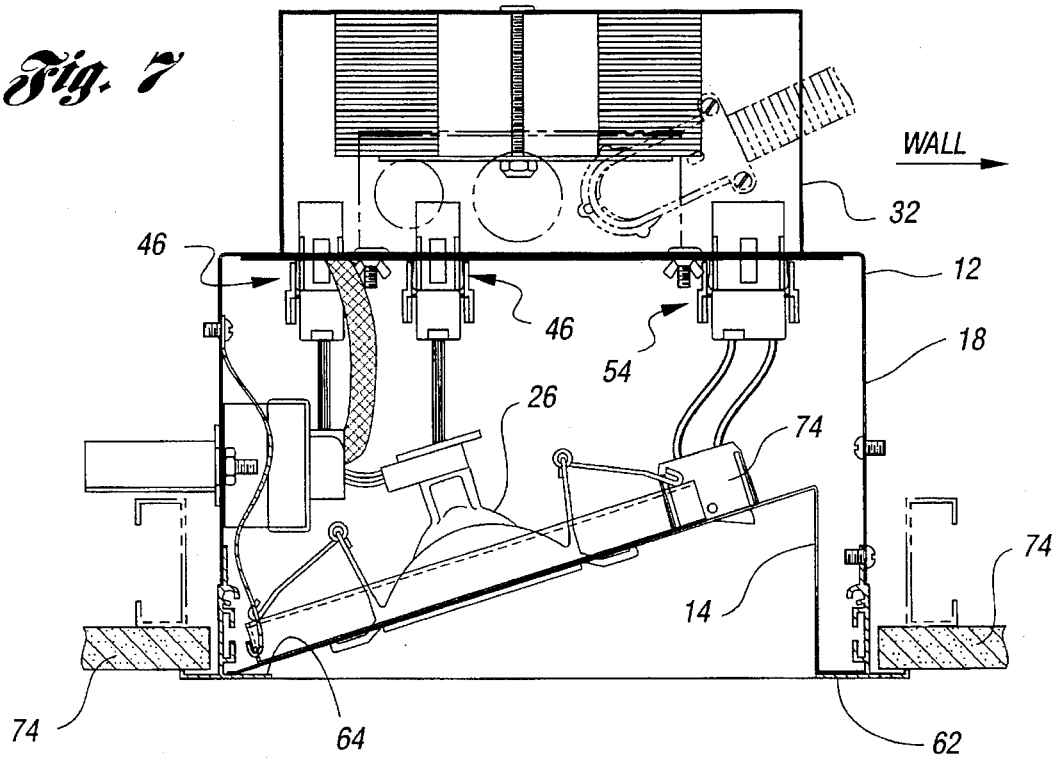
FIG. 7 is a side view cross section of the embodiment of FIG. 1 in its operative position on the flanges of the housing.
Figure 8:
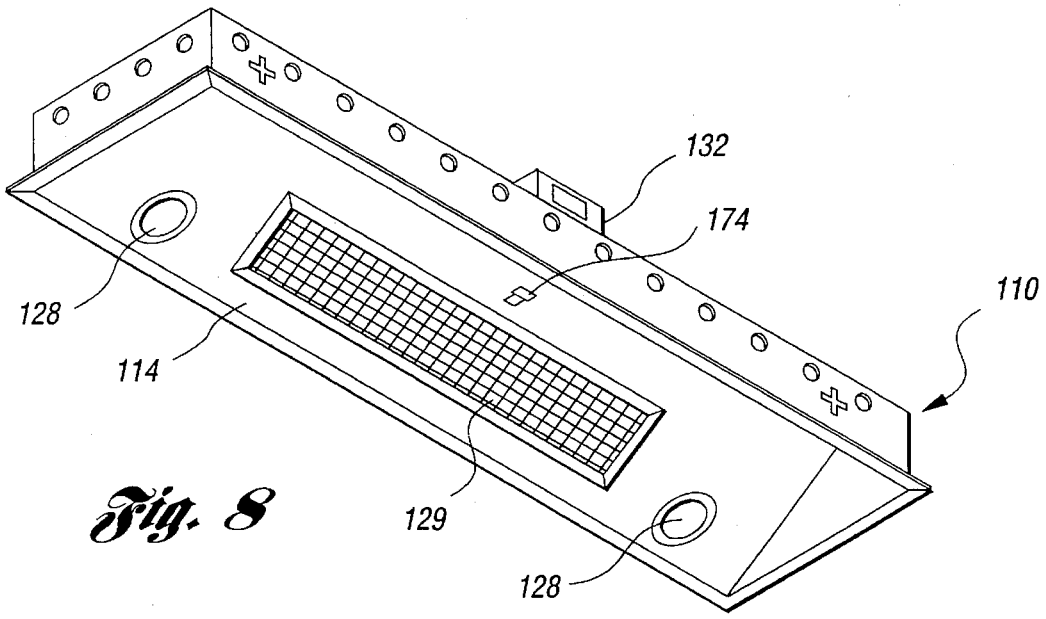
FIG. 8 is a bottom perspective view of a second embodiment of a flange wall wash lighting system of the present invention.
Figure 9:
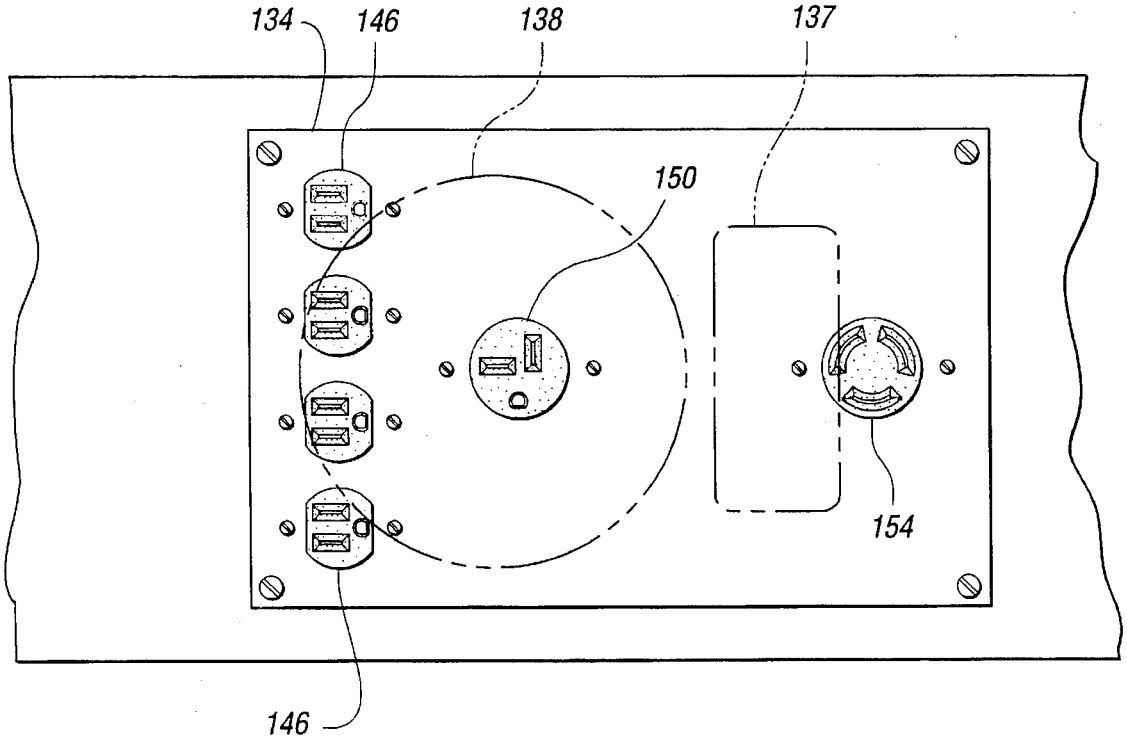
FIG. 9 is a bottom view of the access panel area of the second embodiment.

FIG. 7 and 8 show a second embodiment 110 of the lighting system that allows a greater selection of lamps. The electrical compartment 132 includes a ballast 137 in addition to a transformer 138 so to allow use of a HID lamp in the lighting system. In this embodiment, traditional plugs, rather than the quick connect/disconnect plugs shown, although quick connect/disconnect plugs shown in the first embodiment are normally preferable. Extending through cover plate 134 are four female plugs 146 which are joined to transformer 138. An additional female plug 150 is joined to the ballast 137. Female plug 154 is also provided to allow for connection to switch 174 which will control power to a junction box (not shown). By providing excess electrical connections between the electrical compartment and the lighting box wider lighting options are provided.

For example, the second embodiment allows the same lighting combination shown in the first embodiment to be used since there are four plugs 146 connected to the transformer are still provided. However, if a new design of lighting is desired where an HID lamp is to be used with non-HID lamps, this can be easily undertaken without any tooling. Again, one would climb a ladder to the positions under the lighting system. The lamp tray is rotated to decrease its width and is withdrawn from the interior of the lamp box and the lamps unplugged. Thus, the old lamp tray, having a lamp arrangement such as shown in FIG. 1, is removed. A new lamp tray 114 having a different lighting configuration such as shown in FIG. 8 can then be installed with the lamps 128 to be powered through the transformers being plugged into the plugs 146 and the HID lamp 129 being plugged in the plug 150 leading to the ballast.

If, for some reason, the electrical compartment needs to be accessed, it can be easily accomplished from below. The lamp tray is removed, the plugs are unplugged and the access plate is unscrewed. Placement of the electrical compartment in its control location on the top of the lamp box provides a clear view to the individual below of the electrical elements to allow easy access and viewing during maintenance.

What is claimed is:

1. A flange wall wash lighting system for lighting a wall of a room from a ceiling of the room comprising:

a housing securable through the ceiling at a location near the wall having an interior area accessible through first and second openings;

the first opening communicating between the room and the interior area of the housing when the housing is secured through the ceiling;

the second opening communicating between an electrical control enclosure and the interior area;

the electrical control enclosure is closed from the interior area by a removable panel for said second opening except for electrical connectors to allow electrical communication between the enclosure and the interior area when the second opening is closed;

supports along portions of a perimeter of said first opening;

an elongated first tray having a pair of angularly related legs;

the first tray having a operative position within the interior area where each leg is gravitationally positioned on at least one of the supports so that the first tray remains in the operative position;

a first of said legs of the first tray in the operative position forming an acute angle to the wall and having a series of holes allowing for a series of lamps to be positioned on the other legs which are to be joined to the electrical connectors by wiring and said lamps to be directed to the wall by the angle of the first leg; and the first tray being rotatable by hand within the interior area of the housing so that the legs may clear the supports and the first tray be removed from the interior area of the housing.

2. The lighting system of claim 1, wherein the electrical control enclosure is above the second opening and the second opening lies above and substantially at a center of the first opening and is of such a size as to allow two-hand access into the enclosure.

3. The lighting system of claim 1, wherein electrical connectors comprise first portions of a series of quick connect/disconnect plugs and the wiring comprises a second portion of the quick connect/disconnect plugs.

4. The lighting system of claim 1, wherein the first opening is substantially rectangular with two sides substantially parallel to the wall and the supports comprise a first flat flange portion along one of said sides of the opening closest the wall and a second flat flange portion along another of said sides furthest from the wall.

5. The lighting system of claim 4, wherein each leg has at a free end a foot angularly related to the leg so that when the first tray is in an operative position and each foot is substantially parallel to the flanges and is seated on one of the flanges.

6. The lighting system of claim 1, wherein the series of holes includes not less than three nor more than six holes.

7. The lighting system of claim 1, wherein electrical control enclosure has positioned within it means for controlling ambient lamps and means for controlling non-ambient lamps, and the number of electrical connectors exceed the number of holes of the tray with at least one connector providing power to energize an HID lamp and at least one other connector providing power to energize a non-HID lamp so to allow different combinations of HID and non-HID lamps to be used at different times in conjunction with the housing.

8. The lighting system of claim 7, further comprising a second elongated tray having a pair of angularly related legs and the second tray having an operative position within the interior area where each second tray leg is gravitationally positioned on at least one of the supports so that the second tray remains in the opposite position with a first of said legs of the second tray in an operative position forming an acute angle to the wall and having a series of holes corresponding to a series of lamps positioned on the other of said legs where the second tray joins the electrical connectors;

said lamps having a different pattern of holes than that of the first tray;

said lamps being directed to the wall by the angle of the first leg of the second tray;

the tray being rotatable by hand within the interior area of the housing so that the legs may clear the supports and the second tray be removed from the interior area of the housing; and the first and second tray being alternatively positionable within the housing.

9. A method for installing a wall wash lighting system in a ceiling adjacent a wall to be washed by a light comprising the steps of:

a. providing an opening in the ceiling;

b. positioning in the ceiling opening a housing of the wall wash lighting system where the housing has an interior opening to an area below the ceiling and has a pair of inwardly extending flanges on opposite sides of the opening;

c. providing a source of electric energy for energizing lamps to the interior of the housing;

d. positioning a plurality of lamps at holes in one leg of a pair of angularly related legs of a lamp tray where each leg has a free end;

e. connecting the lamps while outside the housing to the source of electrical energy in the housing;

f. moving the lamp tray into the interior of the housing through the opening by maintaining the lamp tray at an angle where an effective width of the tray is less than a distance between the flanges;

g. rotating the lamp tray while in the interior of the housing so that a effective width of the lamp tray is greater than the distance between the opposing flanges;

h. lowering the tray when the effective width of the lamp tray is greater than the distance between the opposing flanges so that the legs rest on the flanges with the leg on which the lamps are positioned being maintained at an angle to the wall so the lamps will light portions of the wall.

10. A method of claim 9, further comprising a step of after the tray is lowered onto flanges, the lamps are selectively rotated from outside the housing so to allow focusing of the lamps on particular areas of the wall.

11. A method of claim 9, further comprising a step prior to connecting the lamps to the source of electrical energy in the housing of removably attaching to the lamp tray a safety chain attached to the housing.

12. The method of claim 9, wherein the ceiling opening has two sides substantially parallel to the wall and the housing has a pair of outwardly extending flanges on opposite sides of the housing having a distance between their outer ends greater than the parallel sides of the ceiling opening; and wherein the step of positioning the housing in the ceiling opening is accomplished by raising the housing through the ceiling opening with the outwardly extending flanges aligned with the parallel sides of the ceiling until outwardly extending flanges abut the ceiling and then extending locking members through the housing to prevent the housing from being lowered from the ceiling.

13. A wall wash lighting system, comprising:

a housing securable to a ceiling at a location near a wall having an interior area accessible through a substantially rectangular opening communicating between a room and the interior of the housing when the housing is secured through the ceiling;

a source of electrical energy accessible from the interior area of the housing through a series of plugs, a first flange support along a portion along one side of the opening;

a second flange support along a portion of a side of the opening opposite the first flange support;

an elongated tray having a pair of angularly related legs;

the tray having an operative position wherein a first of said legs of the tray forms an acute angle to the wall the first leg which normally rests on the second flange support and having a series of openings through the first leg, the tray having a second of said legs angularly joined to the first leg, having a free end which is gravitationally positioned on the first flange support while the tray is in its operative position;

the tray being rotatable within the interior of the housing so that an effective width on the tray is less than a distance between the flanges so that the legs may clear the supports and the tray be removed from the interior area of the housing.

14. A wall wash lighting system of claim 13, wherein the portion of the electrical energy from the source passes through a ballast to at least one plug of the series so to allow selective positioning of an HID lamp at one of said leg openings.

* * * * *